US007046943B2

(12) United States Patent
Yamazaki

(10) Patent No.: US 7,046,943 B2
(45) **Date of Patent: *May 16, 2006**

(54) IMAGE FORMING APPARATUS AND CHARGING DEVICE THEREFOR RECEIVING AC AND DC VOLTAGES

(75) Inventor: Junichi Yamazaki, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/147,231

(22) Filed: Jun. 8, 2005

(65) Prior Publication Data

US 2005/0232659 A1 Oct. 20, 2005

Related U.S. Application Data

(63) Continuation of application No. 10/611,894, filed on Jul. 3, 2003, now Pat. No. 6,925,275.

(30) Foreign Application Priority Data

Jul. 5, 2002 (JP) ..... 2002-197757

(51) Int. Cl.
*G03G 15/02* (2006.01)

(52) U.S. Cl. ..... 399/176; 361/225

(58) Field of Classification Search ..... 399/174, 399/176; 361/212, 221, 225
See application file for complete search history.

(56) References Cited

U.S. PATENT DOCUMENTS

| | | | | |
|---|---|---|---|---|
| 5,272,506 | A | 12/1993 | Goto et al. | |
| 5,541,711 | A | 7/1996 | Kisu et al. | |
| 5,765,077 | A | 6/1998 | Sakurai et al. | |
| 5,982,606 | A | 11/1999 | Masuda et al. | |
| 6,697,584 | B1 | 2/2004 | Tsunoda et al. | |
| 6,925,275 | B1 * | 8/2005 | Yamazaki | 399/176 |

FOREIGN PATENT DOCUMENTS

| | | |
|---|---|---|
| JP | 6-175472 | 6/1994 |
| JP | 11-258957 | 9/1999 |
| JP | 2000-235298 | 8/2000 |
| JP | 2002-207352 | 7/2002 |

* cited by examiner

*Primary Examiner*—Susan Lee
(74) *Attorney, Agent, or Firm*—Oblon, Spivak, McClelland, Maier & Neustadt, P.C.

(57) ABSTRACT

A charging device includes a charge roller adjoining or contacting the surface of a photoconductive element. A DC and an AC voltage source output a DC and an AC voltage, which are applied to the charge roller. The AC voltage has a waveform pattern of at least one of white noise and pink noise.

10 Claims, 14 Drawing Sheets

FIG. 13

| SAMPLE | CHARGING NOISE | IMAGE QUALITY | TOTAL |
|---|---|---|---|
| EX.1 | NO SOUND WITH PARTICULAR FREQUENCY (FIG.5) | GOOD | GOOD |
| EX.2 | NO SOUND WITH PARTICULAR FREQUENCY | GOOD | GOOD |
| EX.3 | NO SOUND WITH PARTICULAR FREQUENCY | GOOD | GOOD |
| EX.4 | NO SOUND WITH PARTICULAR FREQUENCY | GOOD | GOOD |
| COM.EX.1 | SOUND WITH PARTICULAR FREQUENCY ( FIG.7) | GOOD | NO GOOD |
| COM.EX.2 | SOUND WITH PARTICULAR FREQUENCY | IRREGULARITY | NO GOOD |
| COM.EX.3 | NO SOUND WITH PARTICULAR FREQUENCY | SOME IRREGULARITY | NO GOOD |

IMAGE FORMING APPARATUS AND CHARGING DEVICE THEREFOR RECEIVING AC AND DC VOLTAGES

CROSS-REFERENCE TO RELATED APPLICATIONS

The present application is a continuation of U.S. application Ser. No. 10/611,894 filed on Jul. 3, 2003 now U.S. Pat. No. 6,925,275 and in turn claims priority to JP 2002-197757 filed on Jul. 5, 2002, the entire contents of each of which are hereby incorporated herein by reference.

BACKGROUND OF THE INVENTION

1. Field of the Invention

The present invention relates to a charging device capable of obviating abnormal sound having several frequency peaks ascribable to charging without any irregular charging, and an image forming apparatus including the same.

2. Description of the Background Art

It is a common practice with an electrophotographic image forming apparatus to optically scan the charged surface of a photoconductive drum or image carrier for thereby forming a latent image, deposit toner on the latent image to thereby form a toner image, and transfer the toner image to a sheet or recording medium. To charge the surface of the photoconductive drum, the electrophotographic image forming apparatus has traditionally used a corotron, scorotron or similar wire charging system. However, the wire charging system produces some ozone at the time of charging and is therefore undesirable from an environmental standpoint.

In light of the above, a charging system of the type holding a charge roller or similar charging member, which does not produce ozone, in contact with the photoconductive drum has been proposed. This type of charging system, however, has a problem that when a DC voltage is applied between the charging member and the drum alone, irregular charging occurs. To solve this problem, an AC voltage is usually superposed on the DC voltage to allow the charging member to uniformly charge the surface of the drum.

However, the AC-biased DC voltage mentioned above brings about another problem that an electric field is formed between the charging member applied with the AC voltage and the drum not applied with the AC voltage. The electric field thus formed causes the drum and charging member to repeatedly attract each other, resulting in oscillation between the drum and the charging member. Consequently, at the time of charging, the drum and charging member knock against each other due to the oscillation, producing abnormal sound. The abnormal sound occurs at the frequency of the AC voltage applied and frequencies which are the multiples of the above frequency, as known in the art.

Various technologies have heretofore been proposed to obviate abnormal sound ascribable to the superposition of the AC voltage on the DC voltage, as will be briefly described hereinafter.

Japanese Patent Laid-Open Publication No. 2000-206762, for example, proposes to reduce the oscillation of the surface of the charge roller relative to that of the drum to 150 μm or below and to provide the charge roller with a unique configuration. Japanese Patent Laid-Open Publication No. 2000-330360 teaches that at least NOR (polynorbornene rubber) is contained in the conductive rubber layer of a charge roller.

Japanese Patent Laid-Open Publication No. 5-3505 proposes to establish the following relations between the specific gravity ρ of a photoconductive drum and the frequency f of oscillation voltage applied between the drum and a charge roller:

$$\rho \geqq 1.4\times10^{-3} f \quad (f \leqq 350\ \text{Hz})$$

$$\rho \geqq 4.0\times10^{-4} f + 0.35 \quad (350\ \text{Hz} < f \leqq 1{,}500\ \text{Hz})$$

$$\rho \leqq 0.95 \quad (f > 1{,}500\ \text{hz})$$

Japanese Patent Laid-Open Publication No. 5-142921 teaches that a cylinder formed of urethane rubber whose thermal conductivity is 10 W/m·K or below is disposed inside a photoconductive drum (subject of discharge) in contact with the inner periphery of the drum so as to increase the weight and rigidity of the drum. Likewise, Japanese Patent Laid-Open Publication No. 5-142922 proposes to insert, e.g., a rigid or an elastic body in a photoconductive drum and affix the former to the latter to thereby increase the weight and rigidity of the drum. Further, Japanese Patent Laid-Open Publication Nos. 5-188838, 5-188839 and 5-188840 propose respective schemes for the purpose described above.

However, none of the conventional technologies described above can fully obviate abnormal sound, or charging sound, ascribable to the superposition of the AC voltage on the DC voltage.

There has also been proposed to reduce the frequency of the AC voltage to be applied to a charging member to 10 Hz to 500 Hz in order to reduce abnormal sound. This, however, gives rise to another problem that the charging of the image carrier becomes irregular, resulting in an irregular image. Further, when it comes to a digital PPC (Plain Paper Copier) or a laser printer using a laser beam or an LED (Light Emitting Diode Array), the frequency of the AC voltage as low as 100 Hz to 500 Hz, which is close to a multiple of pixel density, causes moiré to appear in an image.

Moiré cannot be obviated unless the frequency or charging frequency of the AC voltage to be superposed is higher than interference frequency, which is determined by pixel density and process speed. For example, when pixel density and process speed are 600 dpi (dots per inch) and 100 mm/sec, respectively, the charging frequency should be about 1,000 Hz. A future electrophotographic apparatus having a high pixel density, high process speed configuration is expected to need charging frequency of at least about 1,500 Hz. In this respect, the frequency of the AC voltage to be applied to the charging member cannot be lowered below a certain limit.

Moreover, assume that the AC voltage to be superposed on the DC voltage is set such that the peak-to-peak voltage is not higher than two times or more of a charge start voltage. Then, although abnormal noise ascribable to charging can be reduced, sufficient charge cannot be applied to the photoconductive drum with the result that irregular charging is apt to appear on the drum surface in the form of spots. Irregular charging renders an image irregular, as stated earlier.

SUMMARY OF THE INVENTION

It is an object of the present invention to provide a charging device capable of obviating abnormal sound having several frequency peaks at the time of charging without any irregular charging, and an image forming apparatus including the same.

A charging device of the present invention includes a charge roller adjoining or contacting the surface of a photoconductive element. A DC and an AC voltage source output a DC and an AC voltage, respectively. A voltage applying device superposes the DC and AC voltage and applies the resulting superposed voltage to the charge roller. A waveform controller causes the AC voltage source to generate an AC voltage having the waveform pattern of particular noise and frequency lying in a preselected range.

BRIEF DESCRIPTION OF THE DRAWINGS

The above and other objects, features and advantages of the present invention will become more apparent from the following detailed description taken with the accompanying drawings in which:

FIG. 13 is a table comparing Examples 1 through 4 of the present invention and Comparative Examples 1 through 3 as to charging noise, image quality and total estimation.

DESCRIPTION OF THE PREFERRED EMBODIMENTS

Preferred embodiments of the present invention will be described hereinafter.

First Embodiment

Figure 1:
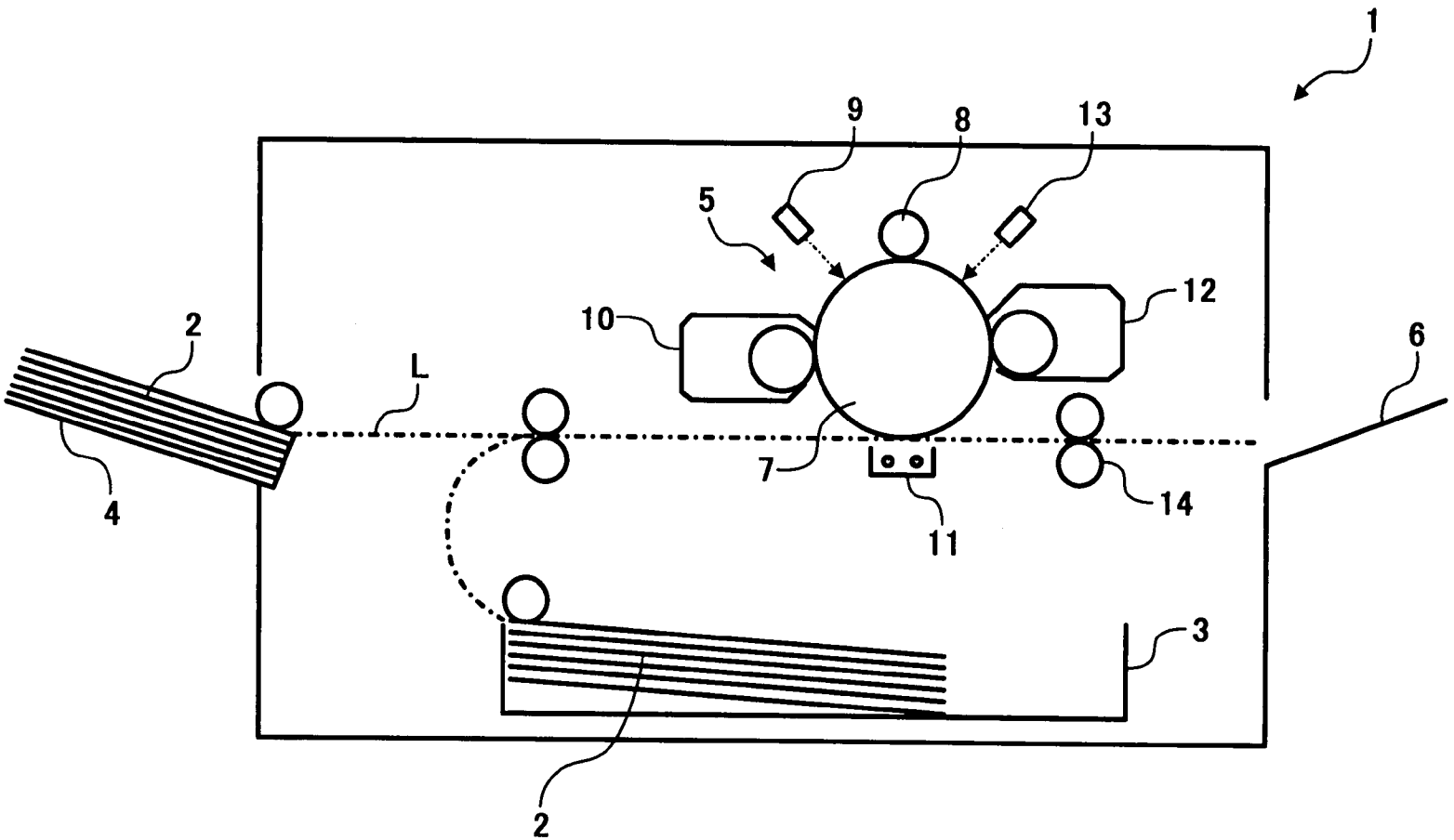
FIG. 1 is a vertical section showing a first embodiment of the image forming apparatus in accordance with the present invention.

A first embodiment of the present invention will be described with reference to FIGS. 1 through 5. In the illustrative embodiment an image forming apparatus is implemented as an electrophotographic printer by way of example. As shown in FIG. 1, the electrophotographic printer, generally 1, includes a sheet path L along which a sheet or recording medium 2 fed from a sheet tray 3 or a manual feed tray 4 is conveyed via an electrophotographic printer engine 5 and then driven out to a print tray 6.

The printer engine 5 includes a photoconductive drum 7, which is a specific form of a photoconductive element or image carrier. A charge roller 8 uniformly charges the surface of the drum 7. A light source section or optical scanning unit 9 scans the charged surface of the drum 7 with a light beam in accordance with image data for thereby forming a latent image. A developing device 10 develops the latent image with toner to thereby produce a corresponding toner image. An image transferring device 11 transfers the toner image from the drum 7 to the sheet 2 fed from the sheet tray 3 or the manual feed tray 4. A cleaning mechanism 12 removes toner left on the drum 7 after image transfer. A fixing mechanism 14 fixes the toner image transferred to the sheet 2.

Figure 2:
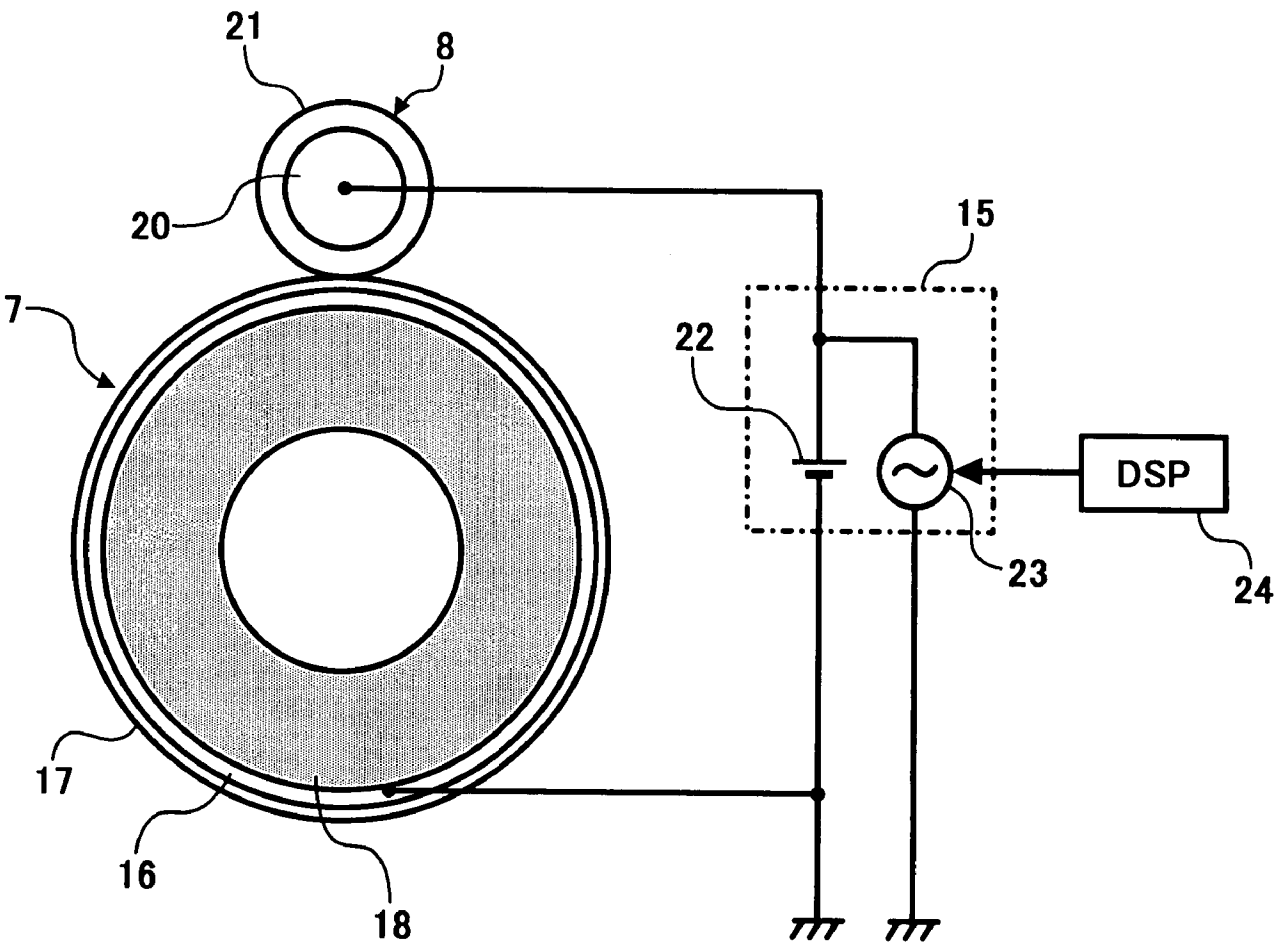
FIG. 2 shows various arrangements included in the first embodiment and relating to charging.

As shown in FIG. 2, a power supply or voltage applying means 15 is connected to the charge roller 8. During image formation, the power supply 15 applies a voltage to the charge roller 8 to thereby establish a potential difference between the charge roller 8 and the drum 7, so that the surface of the drum 7 is charged to a target voltage. Various sections relating to such charging will be described with reference to FIG. 2 hereinafter.

The drum 7 is made up of a hollow cylindrical base 16, a photoconductive layer 17 formed on the outer periphery of the base 16, and a vibration-preventing member 18 provided on the inner periphery of the base 16. The outer periphery of the vibration-preventing member 18 is held in contact with the inner periphery of the base 16.

The base 16 is implemented by a sheet of aluminum, aluminum alloy, nickel, stainless steel or similar metal. The sheet of metal may be configured as a pipe by protrusion or pultrusion and then machined and super-finished, polished or otherwise surface-finished. In the illustrative embodiment, the base 16 is implemented as a pipe formed 3003 aluminum alloy and having an inside and an outside diameter of 30.0 mm and 28.2 mm, respectively, and a length of 340 mm.

While the photoconductive layer 17 may be a single layer or a laminate, it is assumed to be a 30 μm thick laminate made up of a charge generating layer and a charge transport layer in the illustrative embodiment. The major component of the charge generating layer is a charge generating material although the laminate structure is not shown specifically because it is conventional. The charge generating layer should preferably be 0.01 μm to 5 μm thick, more preferably 0.1 μm to 2 μm thick.

For the charge generating material contained in the charge generating layer, use is made of an organic material, e.g., pigment or dye. Typical of the organic material may be monoazo pigment, disazo pigment, trisazo pigment, perylene-based pigment, perynon-based pigment, quinacridone-based pigment, quinone-based condensed polycyclic compound, squaric acid-based dye, phthalocyanine-based pigment, naphthalocyanine-based pigment or azulenium salt-based dye. The above charge generating materials may be used either singly or in combination.

The charge generating layer contains binder resin in addition to the charge generating material mentioned above. As for the binder resin, use may be made of polyamide, polyurethane, epoxy resin, polyketone, polycarbonate, silicone resin, acryl resin, polyvinyl butyral, polyvinyl formal, polyvinyl ketone, polystyrene, polysulfon, poly-N-vinylcarbazole, polyacrylic amide, polyvinyl benzal, polyester, phenoxy resin, vinyl chloride-vinyl acetate copolymer, polyvinyl acetate, polyphenylene oxide, polyamide, polyvinyl pyridine, cellulose-based resin, casein, polyvinyl alcohol or polyvinyl pyrrolidone. The amount of the binder resin should be 20 parts by weight to 200 parts by weight, preferably 50 parts by weight to 150 parts by weight, for 100 parts by weight of the charge generating substance.

The charge generating layer is formed by coating a coating liquid prepared by dissolving or dispersing, if necessary, the above charge generating substance and the binding resin in an adequate solvent on the surface of the base 16 to form a film. The solvent may be any one of isopropanol, acetone, methyl ethyl ketone, cyclohexanone, tetrahydrofuran, dioxane, ethyl cellusolve, ethyl acetate, methyl acetate, dichloromethane, dichloroethane, monochlorobenzene, cyclohexane, toluene, xylene, and ligroin. These solvents can be suitably used, as needed. Any one of dip coating, spray coating, beat coating, nozzle coating, spinner coating, ring coating and other technologies may be used to coat the coating liquid on the base 16.

On the other hand, the charge transport layer contains a charge transport substance as its major component. The film thickness of the charge transport layer should preferably be 5 μm to 50 μm. The charge transport substance is either one of an electron transport substance and a hole transport substance. The electron transport substance may be implemented by any one of chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno[1,2-b]thiophene-4-one, 1,3,7-trinitrodibenzothiophene-5,5-dioxide, benzoquinone derivatives and other electron-receptive substances. The hole transport substance may be implemented by any one of poly-N-carbazole and its derivatives, poly-γ-carbazolylethylglutamate and its derivatives, pyrene-formaldehyde condensate and its derivatives, polyvinylpyrene, polyvinylphenanthrene, polysilane, oxazole derivatives, oxadiazloe derivatives, imidazloe derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These charge transport substances may be used either singly or in combination.

A binder resin is contained in the charge transport layer in addition to the above charge transport substance. For the binder resin of the charge transport layer, use may be made of any one of polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyltoluene, poly-N-vinylcarbazole, acryl resin, silicone resin, epoxy resin, melamine resin, urethane resin, phenol resin, and alkyd resin. The amount of the charge transport substance should be 20 parts by weight to 300 parts by weight, preferably 40 parts by weight to 150 parts by weight, for 100 parts by weight of the binder resin.

The charge transport layer is formed by coating a coating liquid prepared by dissolving or dispersing the above charge transport substances and the binding resin, as needed, in a suitable solvent on the surface of the charge generating layer, and then drying to form a film on the charge generating layer.

As for the solvent used for forming the charge transport layer, use may be made of tetrahydrofuran, dioxane, toluene, dichloromethane, monochlorobenzene, dichloroethane, cyclohexanone, methyl ethyl ketone or acetone by way of example.

Also, a high-polymer charge transport substance, playing the role of a charge transport substance and that of binder resin at the same time, may advantageously be used. The charge transport layer, consisting of such high polymer charge transport substances, has superior wear resistance. While any one of various conventional materials may be used as the high polymer charge transfer substance, polycarbonate containing triarylamine structure in the main chain or the side chain, among others is preferable. For example, high polymer charge transport substances expressed by formulae (1) through (10) in Japanese Patent Laid-Open Publication No. 2000-103984 are advantageously used.

Plasticizers, leveling agents, antioxidants and the like may be added to the coating liquid forming the charge transport layer, as needed. As for the plastisizer, dibutyl phthalate, dioctyl phthalate or similar plastisizer generally used with resins may be directly applied. The amount of the plastisizer should preferably be 0 part by weight to 30 parts by weight for 100 parts by weight of the binder resin.

For the leveling agent, use may be made of dimethyl silicone oil, methylphenyl silicone oil or similar silicone oil or a polymer or an oligomer having perfluoroalkyl group in the side chain. The amount of the leveling agent should preferably be 0 part by weight to 1 part by weight for the binding resin Further, in the drum 7 of the illustrative embodiment, an undercoat layer, not shown, may be formed between the base 16 and the photoconductive layer 17. The undercoat layer is used to, e.g., promote the adhesion of the photoconductive layer 17 to the base 16 although not described specifically because it is known in the art. Generally, the undercoat layer contains resin as its major component and is preferably 0 μm to 5 μm thick. Considering that the photoconductive element 17 is coated no the undercoat layer by a solvent, it is preferable that the resin for the undercoat layer has highly resistant to organic solvents in general. Such resin may be selected from a group of water-soluble resins including polyvinyl alcohol, casein and sodium polyacrylate, a group of alcohol-soluble resins including copolymer nylon and methoxymethylated nylon, and a group of curing type resins forming three-dimensional network structure and including polyurethane, melamine resin, phenol resin, alkyd-melamine resin and epoxy resin.

To obviate moiré and to reduce residual potential, fine powder of titanium oxide, silica, alumina, zirconium oxide, tin oxide, indium oxide or similar metal oxide may be added to the undercoat layer.

Further, for the undercoat layer of the illustrative embodiment, use may be made of a silane coupling agent, a titanium coupling agent or a chromium coupling agent. Moreover, the undercoat layer of the illustrative embodiment may advantageously be implemented as $Al_2O_3$ subjected to anodic oxidation or polyparaxylene (parylene) or similar organic substance or $SiO_2$, $SnO_2$, $TiO_2$, ITO, $CeO_2$ or similar inorganic substance subjected to a vacuum thin film forming method. Any other conventional undercoat layers are also usable.

The undercoat layer may be formed by use of a suitable solvent and a suitable coating method like the photoconductive layer stated earlier.

Further, a protecting layer, not shown, may be stacked on the photoconductive layer 17 of the drum 7 in order to protect the layer 17. The thickness of the protecting layer should preferably be between 0.1 μm and 7 μm. For the protection layer, use may be made of any one of ABS resin, ACS resin, olefin-vinyl monomer copolymer, chlorinated polyether, allyl resin, phenol resin, polyacetal, polyamide, polyamide-imide, polyacrylate, polyallylsulfon, polybutylene, polybutylene terephthalate, polycarbonate, polyethersulfon, polyethylene, polyethylene terephthalate, polyimide, acryl resin, polymethylpentene, polypropylene, polyphenylene oxide, polysulfon, polystyrene, AS resin, butadiene-styrene copolymer, polyurethane, polyvinyl chloride, polyvinylidene chloride, and epoxy resin.

To enhance wear resistance of the protecting layer, polytetrafluoroethylene or similar fluorocarbon resin or silicone resin containing or not containing as titanium oxide, tin oxide, potassium titanate or similar inorganic substance may be added to the protecting layer. Any usual coating method is applicable to the protecting layer. The protecting layer may alternatively be implemented by α-C, α-SiC or similar conventional substance subjected to the vacuum thin film forming method.

In the case where the protecting layer is formed on the photoconductive layer 17, an intermediate layer, not shown, may be formed between the photoconductive layer 17 and the protecting layer, in which case the intermediate layer should preferably be 0.05 μm to 2 μm thick. Generally, the major component of the intermediate layer is binder resin. For this resin, use may be made of polyamide, alcohol-soluble nylon, polyvinyl butyral hydroxide, polyvinyl butyral or polyvinyl alcohol by way of example. The usual coating method stated earlier is applied to the intermediate layer as well.

The charge roller 8 has an axis extending in parallel to the axis of the drum 7 and has its outer periphery adjoining or contacting the drum 7. The charge roller 8 is made up of a core 20 formed of stainless steel or similar metal and an elastic member 21 surrounding the core 20. The elastic member 21 consists of a roller-like foam member or foam layer coaxially formed on the outer periphery of the core 20 and a conductive elastic layer formed on the outer periphery of the foam member, although not shown specifically.

The foam member of the elastic member 21 is formed of, e.g., polystyrene, polyolefin, polyester, polyamide or similar foam material or a soft member formed of EPDM or urethane caused to foam. Carbon, tin oxide or similar conductive powder is dispersed in the foam member in order to lower volumetric resistance. The foam member is provided with a specific weight of 0.1 g/cm$^3$ or above, but 0.6 g/cm$^3$ or below.

The conductive elastic layer of the elastic member 21 consists of a conductive layer stacked on the foam member and a medium resistance layer stacked on the conductive layer. The hardness of the conductive elastic layer should preferably be 60° or below in Askar C scale, more preferably 52° or below. The volumetric resistivity of the conductive elastic layer should preferably be between $10^6$ Ω·cm and $10^{10}$ Ω·cm.

The power supply 15 is made up of a DC voltage source 22 for outputting a DC voltage $V_{DC}$ and an AC voltage source 23 for outputting an AC voltage $V_{Noise}$. The power supply 15 superposes the DC voltage $V_{DC}$ and AC voltage $V_{Noise}$ and apply the resulting voltage $V_{DC}+V_{Noise}$ to the charge roller 8. In the illustrative embodiment, the DC voltage $V_{DC}$ output from the DC voltage source 22 is selected to be −700 V.

Figure 3:
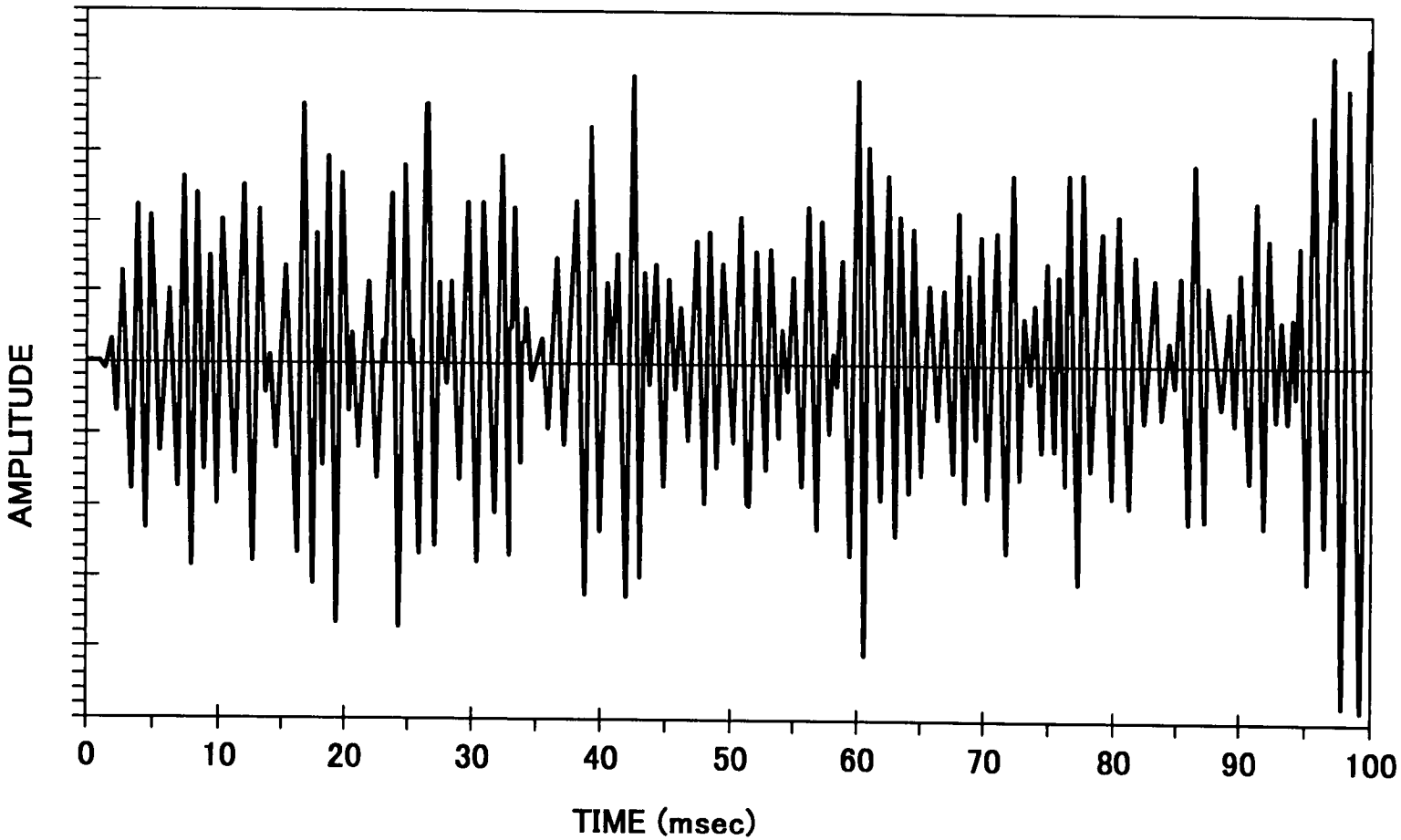
FIG. 3 is a graph showing a specific waveform pattern of white noise generated by a DSP (Digital Signal Processor) included in the first embodiment.
Figure 4A:
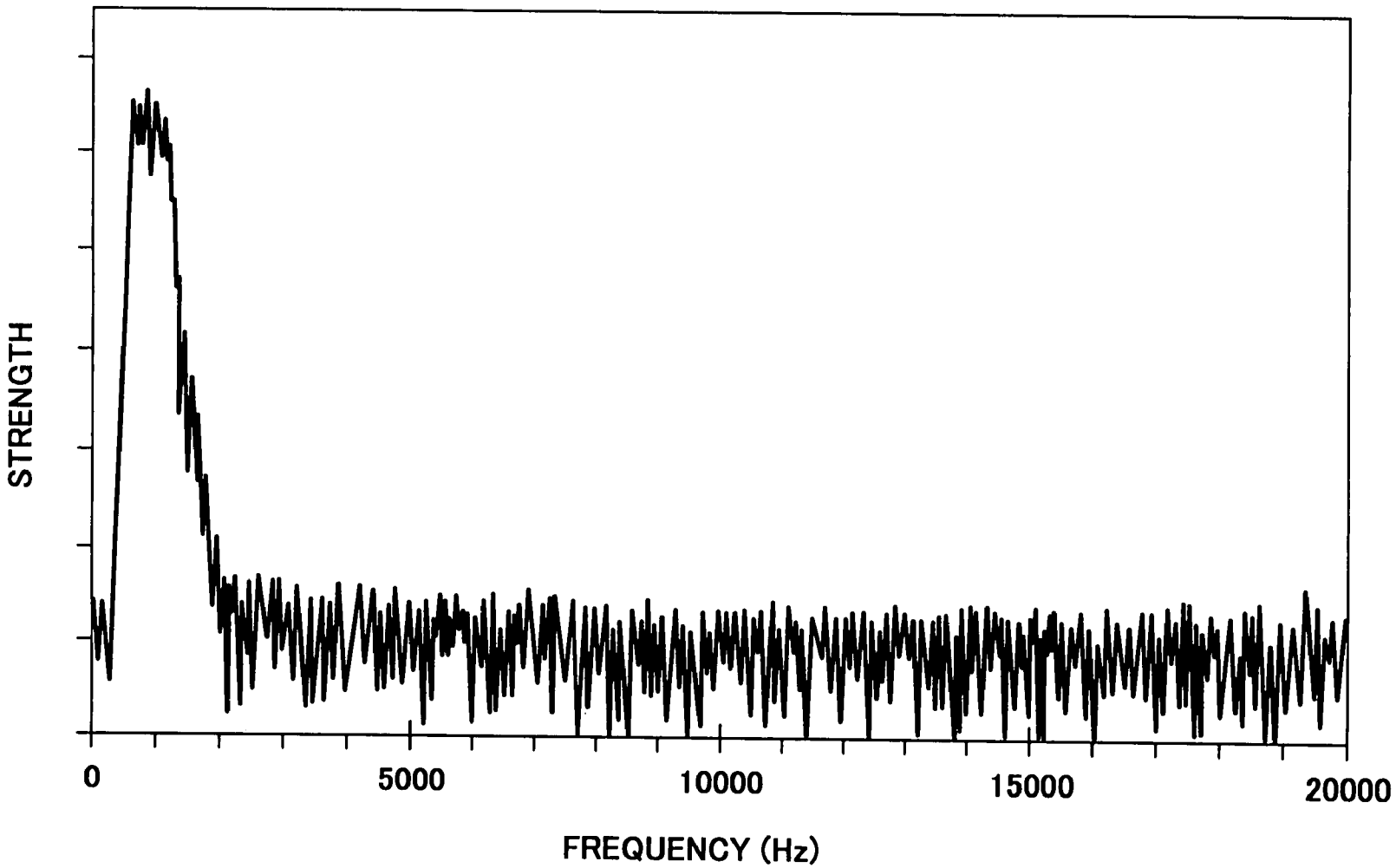
FIGS. 4A and 4B are graphs showing the result of Fourier transform effected with the waveform pattern of FIG. 3.
Figure 4B:
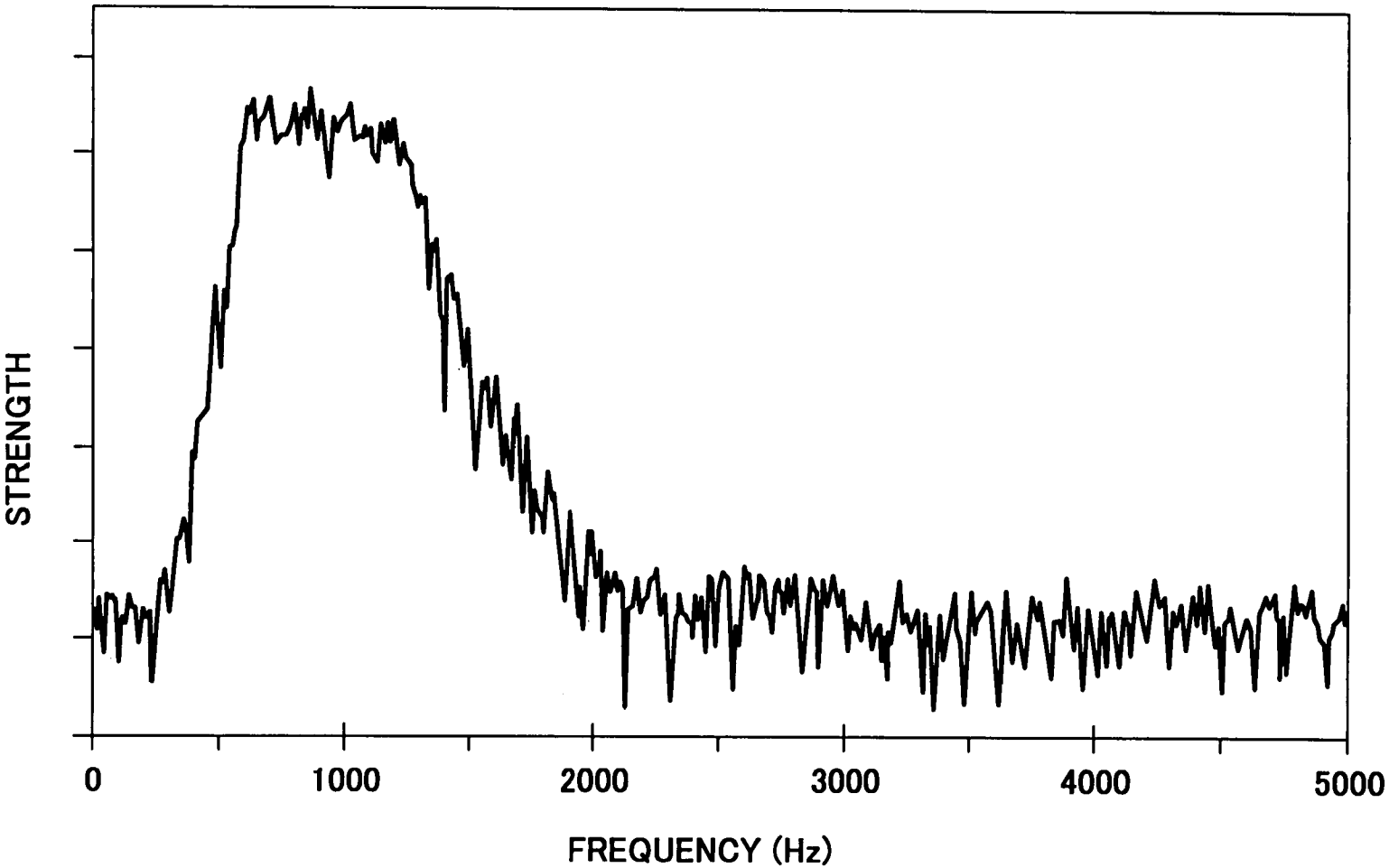

A DSP 24 is connected to the AC voltage source 23. FIG. 3 shows the waveform of white noise generated by the DSP 24 while FIGS. 4A and 4B show waveforms produced by Fourier transform of the waveform pattern shown in FIG. 3. More specifically, FIGS. 4A and 4B respectively show a frequency range of from 0 Hz to 20,000 Hz and a frequency range of from 0 Hz to 5,000 Hz. In the illustrative embodiment, the DSP 24 is implemented by TM320C203 (trade name) available from TEXAS INSTRUMENTS. It is to be noted that the waveform pattern of white noise refers to a waveform pattern in which energy is equal for a unit frequency band.

In the illustrative embodiment, the AC voltage source 23 amplifies the white noise waveform pattern output from the DSP 24 such that a peak-to-peak voltage falls between 1,500 V and 2,500 V, thereby generating the AC voltage $V_{Noise}$ whose frequency ranges from 500 Hz to 4,000 Hz. In this sense, the AC voltage source 23 plays the role of waveform control means. The frequency of the AC voltage $V_{noise}$ should more preferably be between 800 Hz and 2,000 Hz. In the illustrative embodiment, the waveform pattern is so amplified as to provide the AC voltage $V_{Noise}$ with a peak-to-peak voltage of 1,800 V. It is to be noted that the peak-to-peak voltage may be suitably selected in matching relation to the drum 7 to be charged.

Further, the AC voltage source 23 samples the white noise waveform pattern output from the DSP 24 at a sampling frequency of 44.1 kHz to thereby digitally reproduce the AC voltage $V_{Noise}$. The sampling frequency of 44.1 kHz is only illustrative and may be replaced with any other suitable frequency so long as it is 6 kHz or above. The sampling frequency should preferably be 20 kHz or above. A sampling frequency below 6 kHz makes it impossible to sufficiently reduce noise having several frequency peaks. A sampling frequency above 100 kHz does not show any further improvement as to the reduction of noise having several frequency peaks. The sampling frequency should therefore be 100 kHz or below. The sampling frequency of 44.1 kHz allows the capacity of a memory capacity used to be reduced, compared to a sampling frequency above 44.1 kHz.

The mean effective value of the AC voltage $V_{Noise}$ applied from the power supply 15 to the core 20 of the charge roller 8 should be 2 mA or below, preferably 1.5 mA or below.

The printer 1 having the construction described above was actually operated to print, at linear velocity of 230 mm/sec, images on sheets of size A4 fed in the profile position (297 mm). Even when nose was sampled at the frequency of 44.1 kHz, it was possible to obviate abnormal sound having several frequency peaks by superposing the AC voltage $V_{Noise}$ for about 1.3 seconds at the time of charging.

Figure 5:
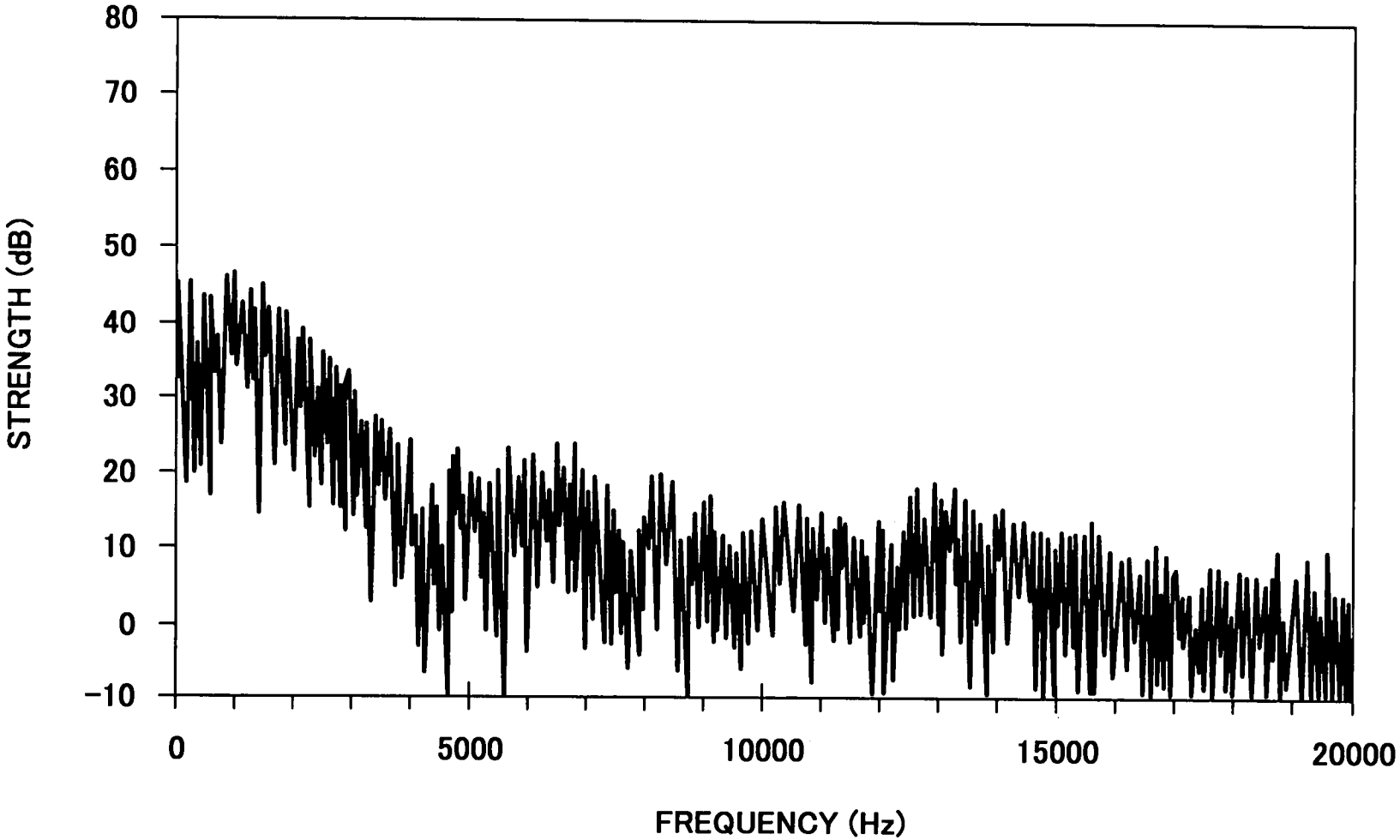
FIG. 5 is a graph showing the result of Fourier transform effected with the waveform of sound output from a printer at the time of charging.

FIG. 5 shows a waveform produced by obtaining sound output from the printer 1 at the time of charging and then subjecting it to Fourier transform. As FIG. 5 also indicates, no noticeable peaks appear over the entire frequency band to be used, i.e., the printer 1 does not produce any abnormal sound having several frequency peaks at the time of charging.

Second Embodiment

A second embodiment of the present invention will be described with reference to FIG. 6. This embodiment is also practicable with the printer 1 shown in FIG. 1. In the illustrative embodiment, parts and elements identical with those of the first embodiment are designated by identical reference numerals and will not be described specifically in order to avoid redundancy.

In the illustrative embodiment, the DSP 24 generates the waveform pattern of pink noise, so that the AC voltage source 23 generates an AC voltage $V_{Noise}$ having the waveform pattern of pink noise. Pink noise refers to random noise whose energy decreases to one-half when frequency is doubled in the range of from 20 Hz to 20 kHz. The frequency range of the AC voltage $V_{Noise}$ is selected to fall between 500 Hz and 4,000 Hz. The frequency of the pink noise waveform pattern generated by the AC voltage source 23 should more preferably be between 800 Hz and 2,000 Hz.

Figure 11:
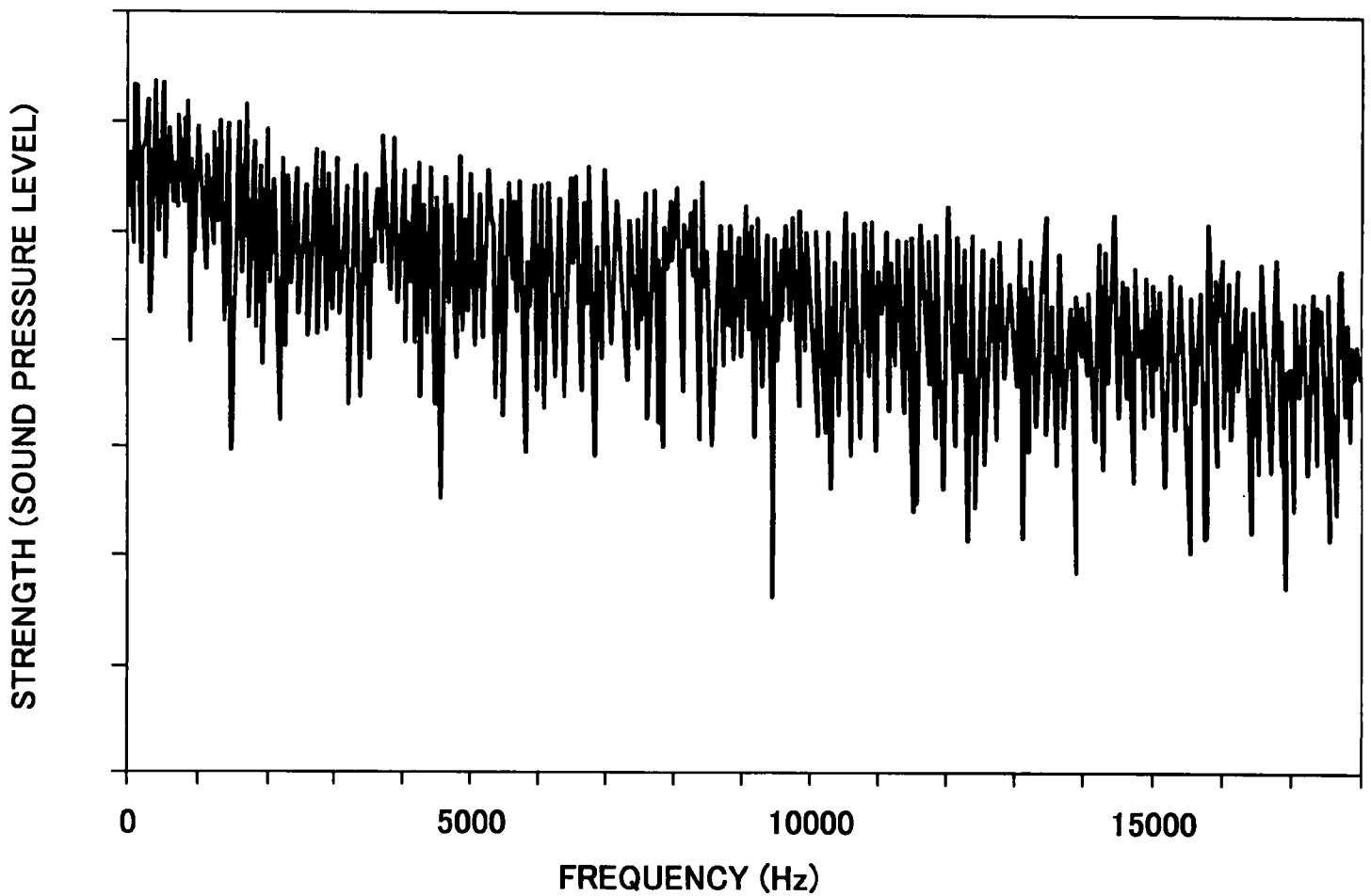
FIG. 11 is a graph showing a specific spectrum of pink noise lying in the frequency range of from 1 Hz to 1,800 Hz.
Figure 12:
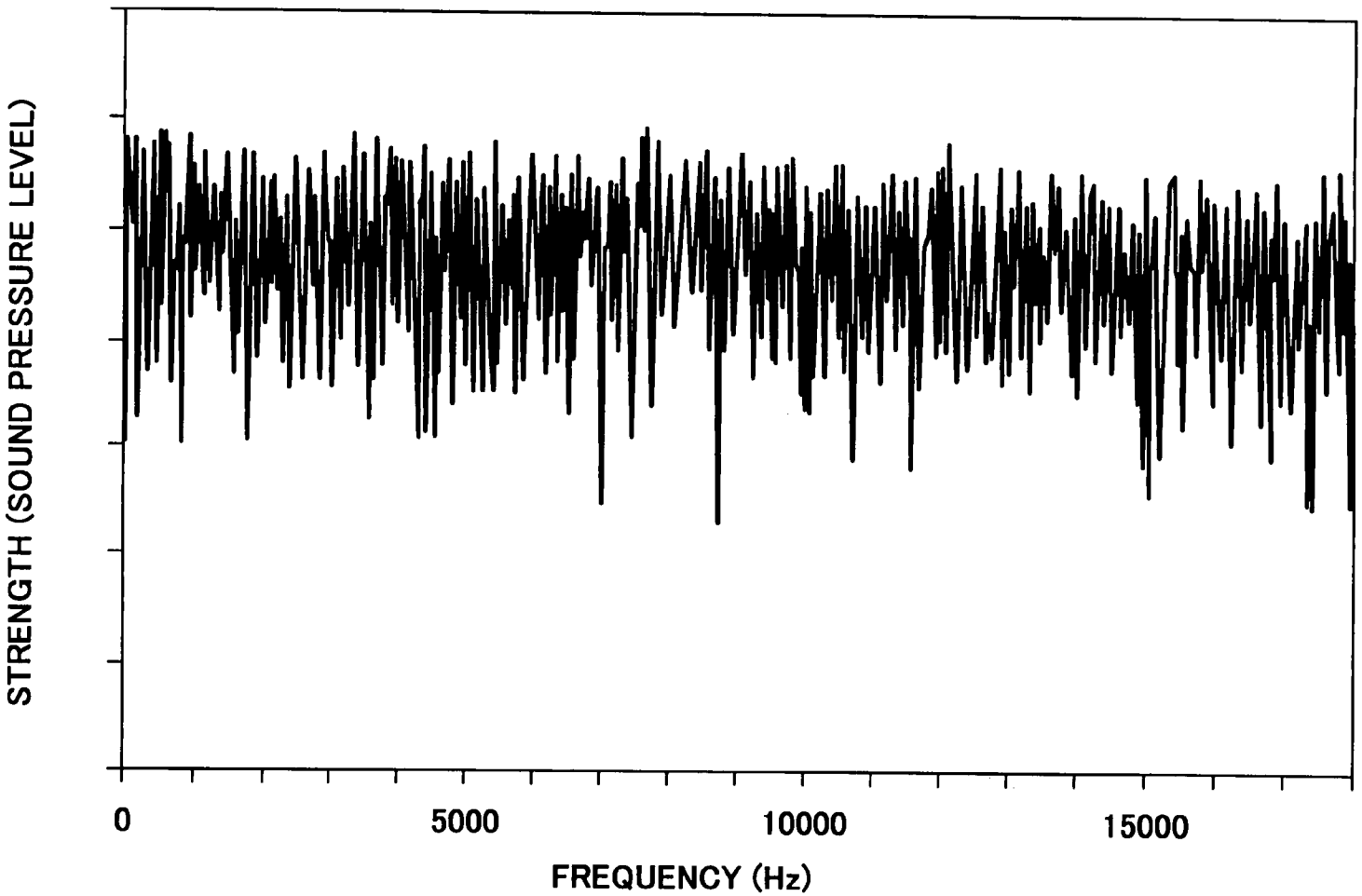
FIG. 12 is a graph showing a specific spectrum of white noise lying in the frequency range of from 1 Hz to 1,800 Hz.

In the illustrative embodiment, the description of white noise and pink noise accords to the following definition presented in "McGraw-Hill Dictionary of Scientific and Technical Terms", Second Edition, published by THE NIKKAN KOGYO SHINBUN LTD. on Mar. 25, 1985:

white noise: random noise whose energy for a unit band width is constant for all oscillation frequencies pink noise: broad-band noise with a spectrum in which power for a unit frequency is inversely proportional to frequency such that energy is constant every octave band FIGS. 11 and 12 respectively show a specific spectrum of pink noise whose frequency range is between 1 Hz and 1,800 Hz and a specific spectrum of white noise whose frequency is also between 1 Hz and 1,800 Hz.

The peak-to-peak voltage of the AC voltage $V_{Noise}$ having the pink noise waveform pattern should preferably fall between 1,500 V and 2,500 V and may be suitably selected in matching relation to the drum 7 to be charged.

Figure 6:
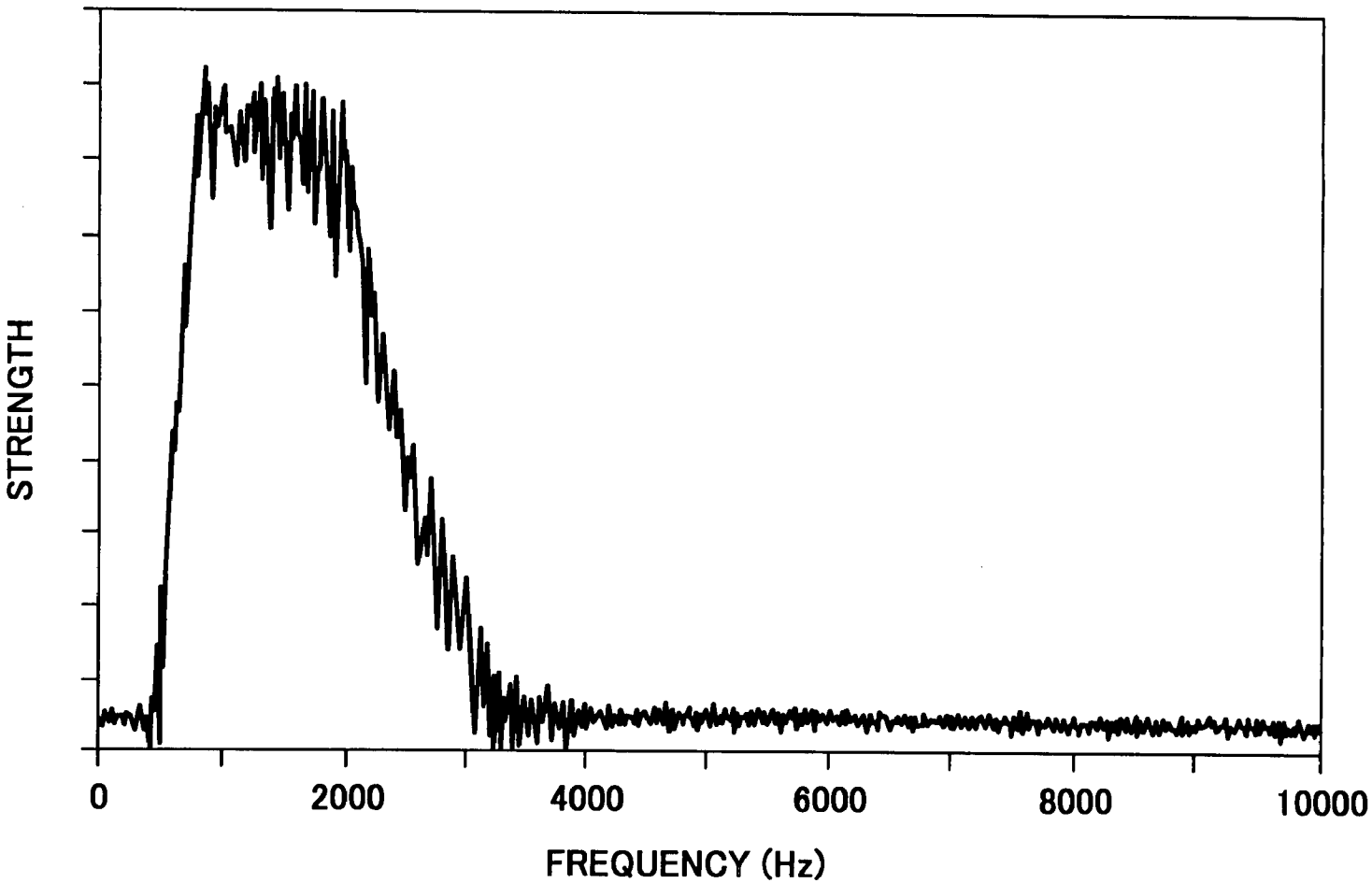
FIG. 6 is a graph showing the result of Fourier transform effected with the waveform of pink noise output from a DSP included in a second embodiment of the present invention.

FIG. 6 shows the result of Fourier transform effected with the pink noise waveform pattern. The waveform pattern of the AC voltage $V_{Noise}$ to be superposed on the DC voltage $V_{DC}$ may be a white noise waveform pattern as in the first embodiment. However, when the frequency range of noise is ½ octave or *above*, by applying the sum voltage $V_{DC}+V_{Noise}$, in which $V_{Noise}$ has the pink noise waveform pattern as in the illustrative embodiment, to the charge roller 8, it is possible to obviate abnormal sound to be output from the printer 1 and having several frequency peaks. The resulting sound output from the printer 1 is therefore not annoying. Should sound output from the printer 1 has several frequency peaks, it would be shrill and annoying.

So long as the frequency range of noise is ⅓ octave or *below*, there is any noticeable difference between the case wherein the AC voltage $V_{Noise}$ superposed has the white noise waveform pattern and the case wherein it has the pink noise waveform pattern.

Third Embodiment

Figure 7:
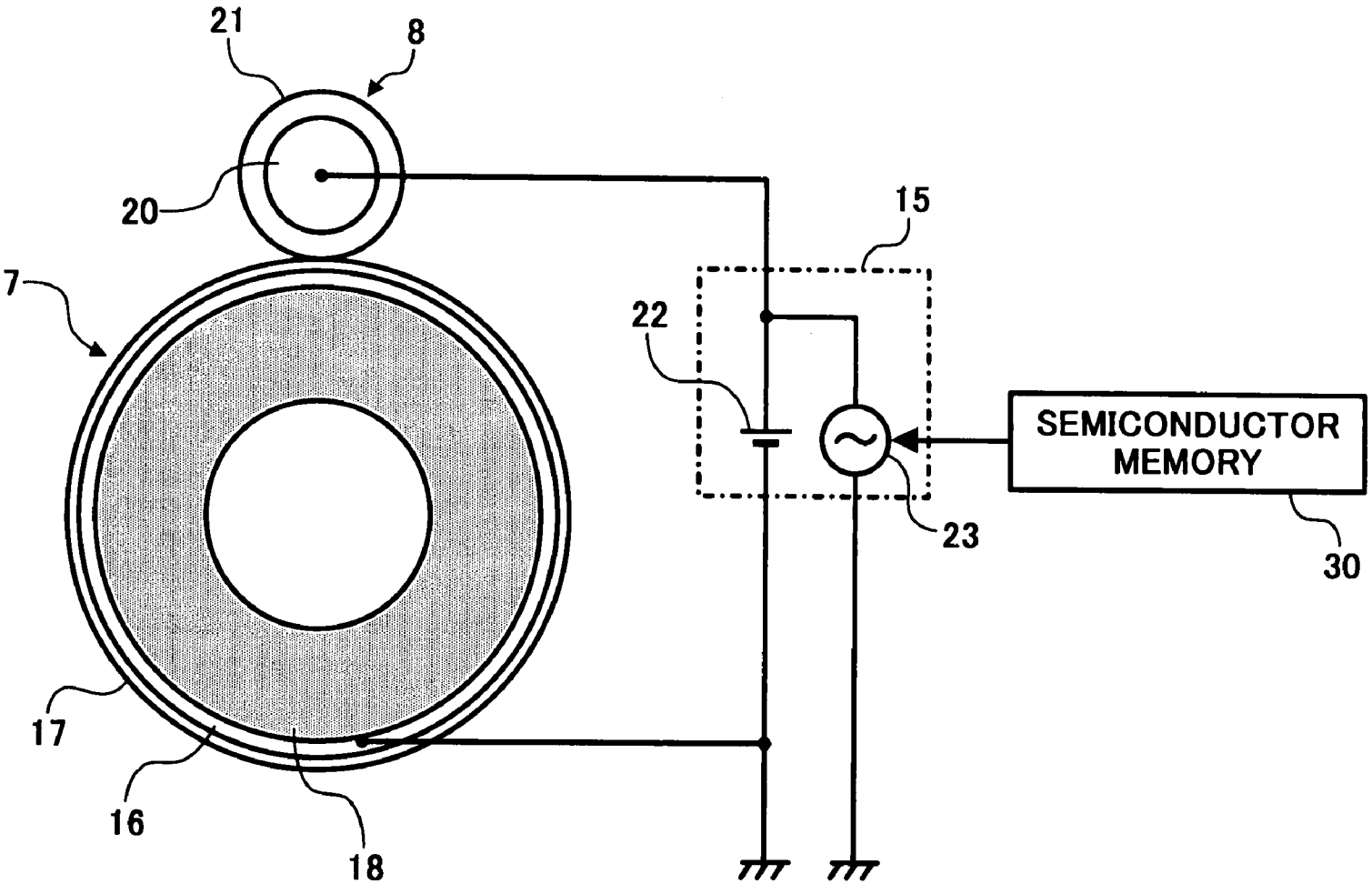
FIG. 7 shows various arrangements included in a third embodiment of the present invention and relating to charging.

Reference will be made to FIG. 7 for describing a third embodiment of the present invention. This embodiment is also practicable with the printer 1, FIG. 1, except for the following. As shown, in the illustrative embodiment, a semiconductor memory 30 is substituted for the DSP 24 and stores the waveform pattern of particular noise. The AC voltage source 23 generates the AC voltage $V_{Noise}$ in accordance with the waveform pattern stored in the semiconductor memory 30.

The waveform pattern stored in the semiconductor memory 30 may be either one of the white noise waveform pattern and pink noise waveform pattern. In the illustrative embodiment, the memory 30 stores a waveform pattern produced by sampling the waveform pattern of pink noise, which lies in the frequency range of from 100 Hz to 20,000 Hz, at the sampling frequency of 44.1 kHz and then separating the frequency range of from 600 Hz to 1,500 Hz with a band-pass filter.

In the above configuration, at the time of charging, the pink noise waveform pattern is read out from the semiconductor memory 30. Subsequently, the AC voltage $V_{Noise}$ amplified such that the peak-to-peak voltage of the waveform pattern thus read out is 1,800 V is superposed on a −700 V DC voltage $V_{DC}$ to thereby apply the resulting sum voltage $V_{DC}+V_{Noise}$ to the charge roller 8. It was experimentally found that when the waveform of sound output from the printer 1 was subjected to Fourier transform, no noticeable peaks appeared over the entire frequency range. This proves that sound output from the printer 1 is free from several peaks.

Fourth Embodiment

A fourth embodiment to be described hereinafter differs from the third embodiment in that the semiconductor memory 30 stores the waveforms of a plurality of different particular noises. More specifically, in the illustrative embodiment, the semiconductor memory 30 stores a waveform pattern produced by sampling the pink noise waveform pattern whose frequency range is between 100 Hz and 20,000 Hz at the sampling frequency of 44.1 kHz and then separating the frequency range of from 600 Hz to 1,500 Hz with a band-pass filter. In addition, the memory 30 stores a waveform produced by sampling the white noise waveform pattern whose frequency range is between 100 Hz and 20,000 Hz at the sampling frequency of 44.1 kHz.

In the above configuration, the two different waveforms stored in the semiconductor memory 30 are selectively used by the AC power supply 23. At the time of charging, the AC voltage source 23 generates the AC voltage $V_{Noise}$ by amplifying the waveform pattern read out from the memory 30 such that the peak-to-peak voltage is 1,800 V. Subsequently, the AC voltage source 15 superposes the AC voltage $V_{Noise}$ on the −700 V DC voltage $V_{DC}$ output from the DC voltage source 22 to thereby apply the resulting sum voltage $V_{DC}+V_{Noise}$ to the charge roller 8. Again, it was experimentally found that when the waveform of sound output from the printer 1 was subjected to Fourier transform, no noticeable peaks appeared over the entire frequency range. This proves that sound output from the printer 1 is free from several peaks.

Fifth Embodiment

Figure 8:
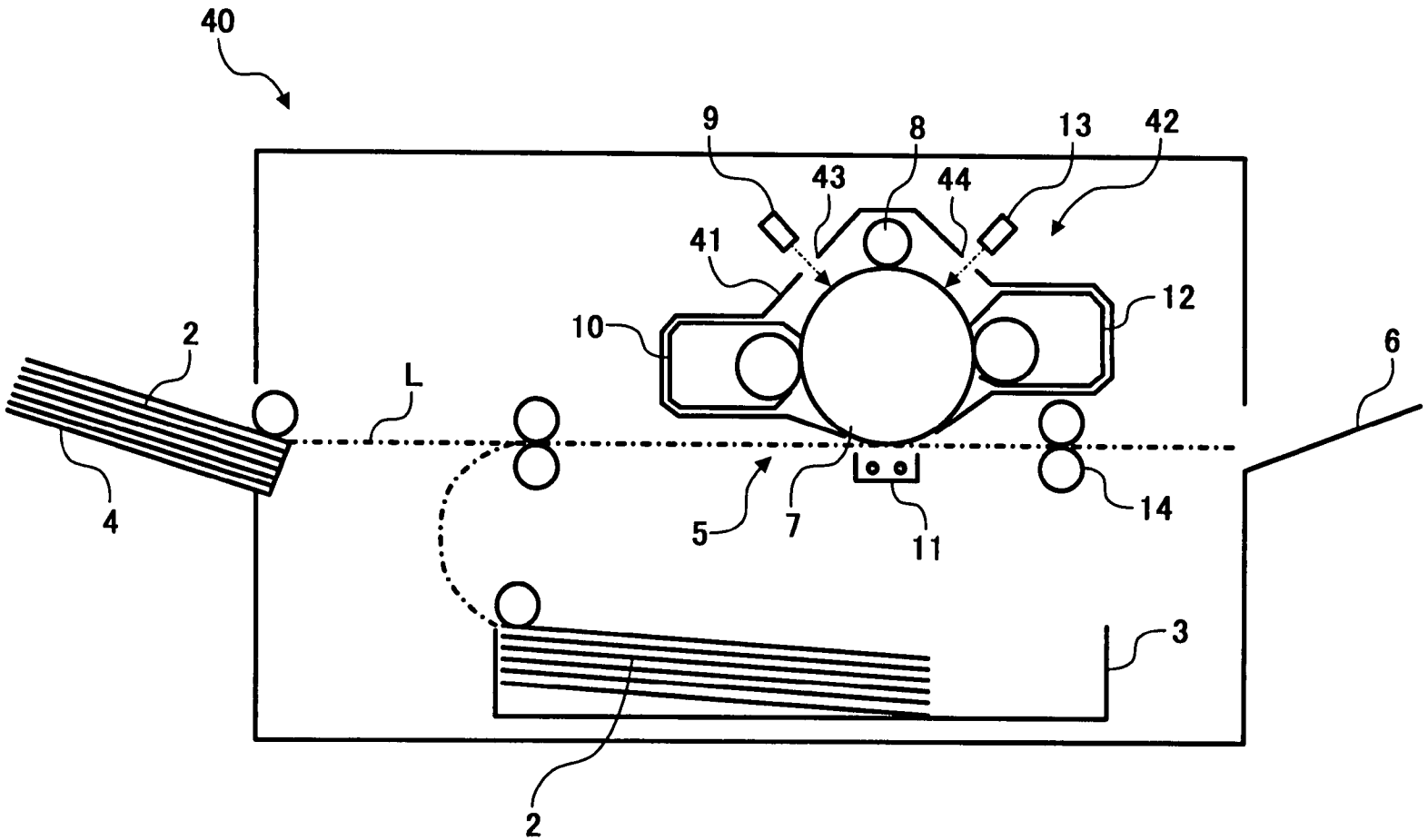
FIG. 8 is a section showing a fifth embodiment of the present invention.

FIG. 8 shows a printer 40 representative of a fifth embodiment of the present invention. As shown, the printer 40 includes a process cartridge 42 having a cartridge case 41 that accommodates part of the structural elements constituting a printer engine, i.e., the drum 7, charge roller 8, developing unit 10 and cleaning mechanism 12. The cartridge case 41 is formed with openings 43 and 44 via which light beams, issuing from the light source section 9 and a discharging mechanism 13, are incident to the drum 7. The process cartridge 42 is removably mounted to the body of the printer 40. The light source section 15 and the drum 7 and charge roller 8 are electrically connected together, but can be disconnected, as needed.

The process cartridge 42 is removable from the body of the printer 40, as stated above. Therefore, when the life of any one of the members mounted on the process cartridge 42 ends or when any one of the members fails, the process cartridge 42 can be bodily replaced and therefore obviates irregular charging and abnormal noise ascribable to charging. Moreover, process units mounted on the body of the printer 40 and longer in life than the members of the process cartridge 42 can be continuously used.

Sixth Embodiment

Figure 9:
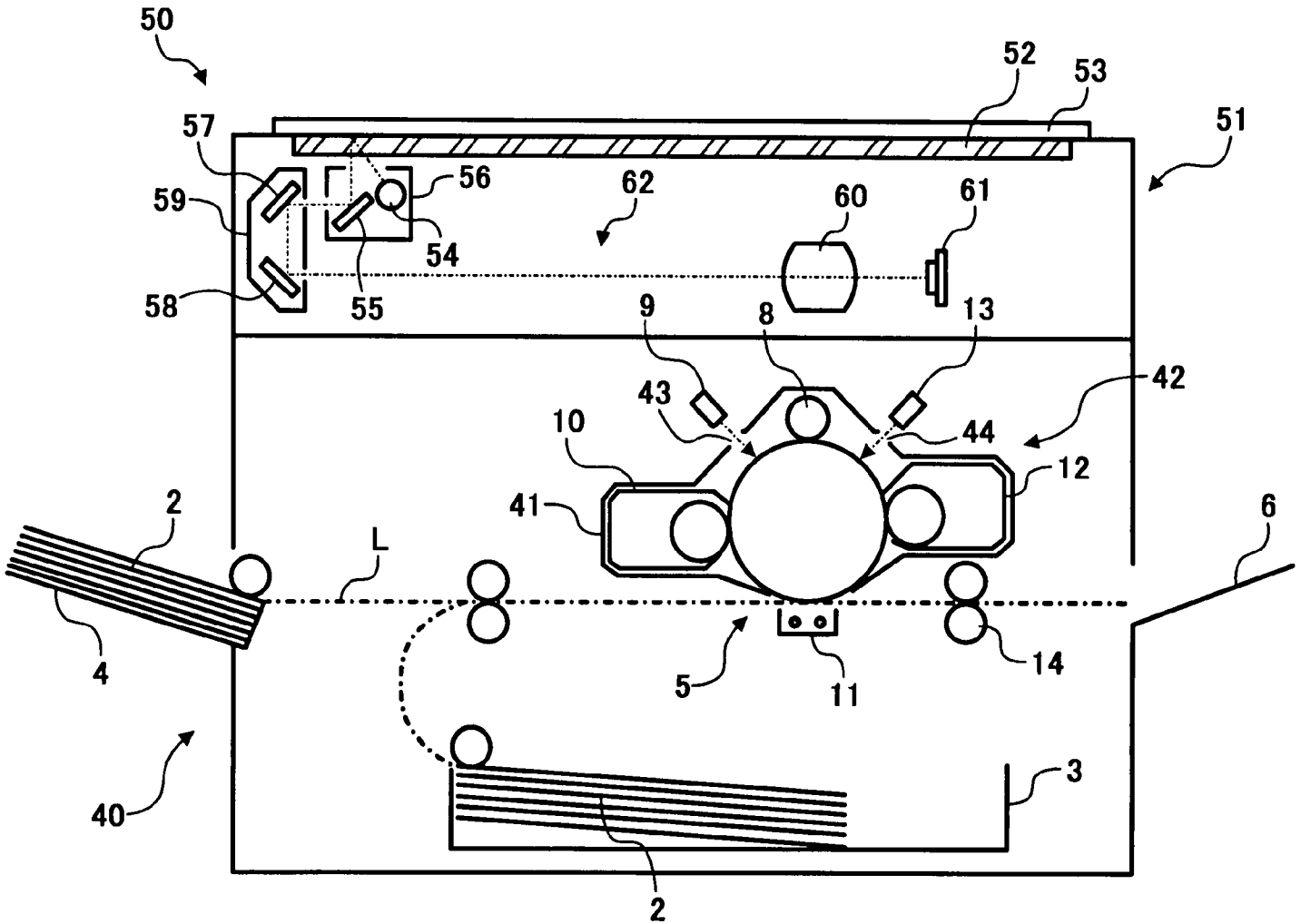
FIG. 9 is a vertical section showing a sixth embodiment of the present invention.

FIG. 9 shows a sixth embodiment of the present invention and implemented as a copier 50. As shown, the copier 50 is generally made up of a scanner or image reading unit 51 and the printer 40 configured to print an image read by the scanner 51 on a sheet. The scanner 51 includes a glass platen 52 on which a document, not shown, is to be laid with its image surface facing the glass platen 52. A cover plate 53 is positioned above the glass platen 52 for pressing the document laid on the glass platen 52.

Image reading optics 62 is arranged below the glass platen 52 and includes a first and a second carriage 56 and 59 and a CCD (Charge Coupled Device) image sensor 61. The first carriage 56 is loaded with a light source 54 and a mirror 55 while the second carriage 59 is loaded with two mirrors 57 and 58. Imagewise reflection from the document is guided by the mirrors 55, 57 and 58 to the CCD image sensor 61 via a lens 60. The image sensor or photoelectric transducer 61 converts the incident light to corresponding image data. The image data thus output from the image sensor 61 are processed by an image processor, not shown, to become digital image data. The first and second carriages 56 and 59 are movable back and forth along the glass platen 52 and caused to run at a speed ratio of 2:1 by a motor or similar drive source not shown.

In the printer 40, the printer engine is driven in accordance with the digital image data output from the image processor, forming an image on the sheet 2.

The copier 50, including the printer 40, is free from irregular charging and therefore insures high-quality images while obviating abnormal sound having several frequency peaks at the time of charging.

Examples 1 through 4 of the illustrative embodiments and Comparative Examples 1 through 3, which will be described hereinafter, were compared as to sound derived from charging and image quality.

EXAMPLE 1

Example 1 uses the same image forming apparatus as the first embodiment. The drum 7 is made up of a base 16 implemented by a 3003 aluminum alloy pipe having an outside diameter of 30.0 mm, an inside diameter of 28.2 mm and a length of 340 mm and a 30 μm thick photoconductive layer 17. The charge roller 8 includes a stainless steel core 20 having a diameter of 100 mm and a 3 mm thick elastic body 21 formed of epichlorohydrine rubber and having resistivity of $2\times10^{8}$ Ω·cm. Further, an epichlorohydrine rubber and fluorine-based resin having resistivity of $8\times10^{10}$ Ω·cm are coated on the surface of the charge roller 8 to thickness of 50 μm, forming a surface layer.

The DSP 24, implemented by TMS320C203 available from TEXAS INSTRUMENTS, generated a white noise waveform pattern. In the power supply 15, the AC voltage source 23 generated an AC voltage by amplifying the white nozzle waveform pattern such that the peak-to-peak voltage was 1,800 V. The AC voltage thus generated was superposed on a −700 V DC voltage generated by the DC voltage source 22. Image formation was effected with the resulting sum voltage being applied to the charge roller 8. The result of image formation is shown in FIG. 13. In FIG. 13, sound with particular frequency refers to sound having several (two to five) frequency peaks.

As FIG. 13 indicates, when sound measured at the time of charging was subjected to Fourier transport, no noticeable peaks appeared over the entire frequency band (see FIG. 5), i.e., sound with several frequency peaks disappeared. Further, images were free from irregularity or similar defect and high quality.

EXAMPLE 2

Example 2 is identical with Example 1 except that the DSP 24 generates an AC voltage having a pink noise waveform pattern. In the power supply 15, the AC voltage source 23 amplified the pink noise wave pattern output from the DSP 24 such that the peak-to-peak voltage was 2,000 V, thereby outputting an AC voltage whose frequency was between 600 Hz and 2,000 Hz. The AC voltage thus generated was superposed on a −700 V DC voltage output from the DC voltage source 22. Image formation was effected with the resulting sum voltage being applied to the charge roller 8. The sampling frequency was 44.1 kHz. The result of Example 2 is also shown in FIG. 13.

As FIG. 13 indicates, when sound measured at the time of charging was subjected to Fourier transport, no noticeable peaks appeared over the entire frequency band, i.e., sound with several frequency peaks disappeared. Further, images were free from irregularity or similar defect and high quality.

EXAMPLE 3

Example 3 has the same configuration as the third embodiment. In Example 3, the semiconductor memory 30 stores a waveform pattern produced by sampling pink noise, which lies in the frequency range of from 100 Hz to 20,000 Hz, at the sampling frequency of 44.1 kHz to there by effect digital reproduction, and then separating the frequency range of from 600 Hz to 1,500 Hz with a band-pass filter.

In the power supply 15, the AC voltage source 23 generated an AC voltage by amplifying the pink noise waveform pattern stored in the memory 30 such that the peak-to-peak voltage was 1,800 V. The AC voltage thus generated was superposed on a −700 V DC voltage output from the DC voltage source 22. The resulting sum voltage was applied to the charge roller 8. The result of image formation is also shown in FIG. 13.

As FIG. 13 indicates, when sound measured at the time of charging was subjected to Fourier transport, no noticeable peaks appeared over the entire frequency band, i.e., sound with several frequency peaks disappeared. Further, images were free from irregularity or similar defect and high quality.

EXAMPLE 4

Example 4 has the same configuration as the fourth embodiment. In Example 4, the semiconductor memory 30 stores a waveform pattern produced by sampling the pink noise waveform pattern whose frequency range is between 100 Hz and 20,000 Hz at the sampling frequency of 44.1 kHz and then separating the frequency range of from 600 Hz to 1,500 Hz with a band-pass filter. In addition, the memory 30 stores a waveform produced by sampling the white noise waveform pattern whose frequency range is between 100 Hz and 20,000 Hz at the sampling frequency of 44.1 kHz.

In the power supply 15, the AC voltage source 23 generated AC voltages $V_{Noise}$ by amplifying the two kinds of waveform patterns stored in the memory 30 such that the peak-to-peak voltage was 1,800 V. Subsequently, the AC voltages each were superposed in a 700 V AC voltage output from the DC voltage source 22 to thereby apply the resulting sum voltage to the charge roller 8. The result of image forming effected in this condition is also shown in FIG. 13.

As FIG. 13 indicates, when sound measured at the time of charging was subjected to Fourier transport, no noticeable peaks appeared over the entire frequency band, i.e., sound with several frequency peaks disappeared without regard to the kind of the waveform pattern. Further, images were free from irregularity or similar defect and high quality.

COMPARATIVE EXAMPLE 1

Figure 10:
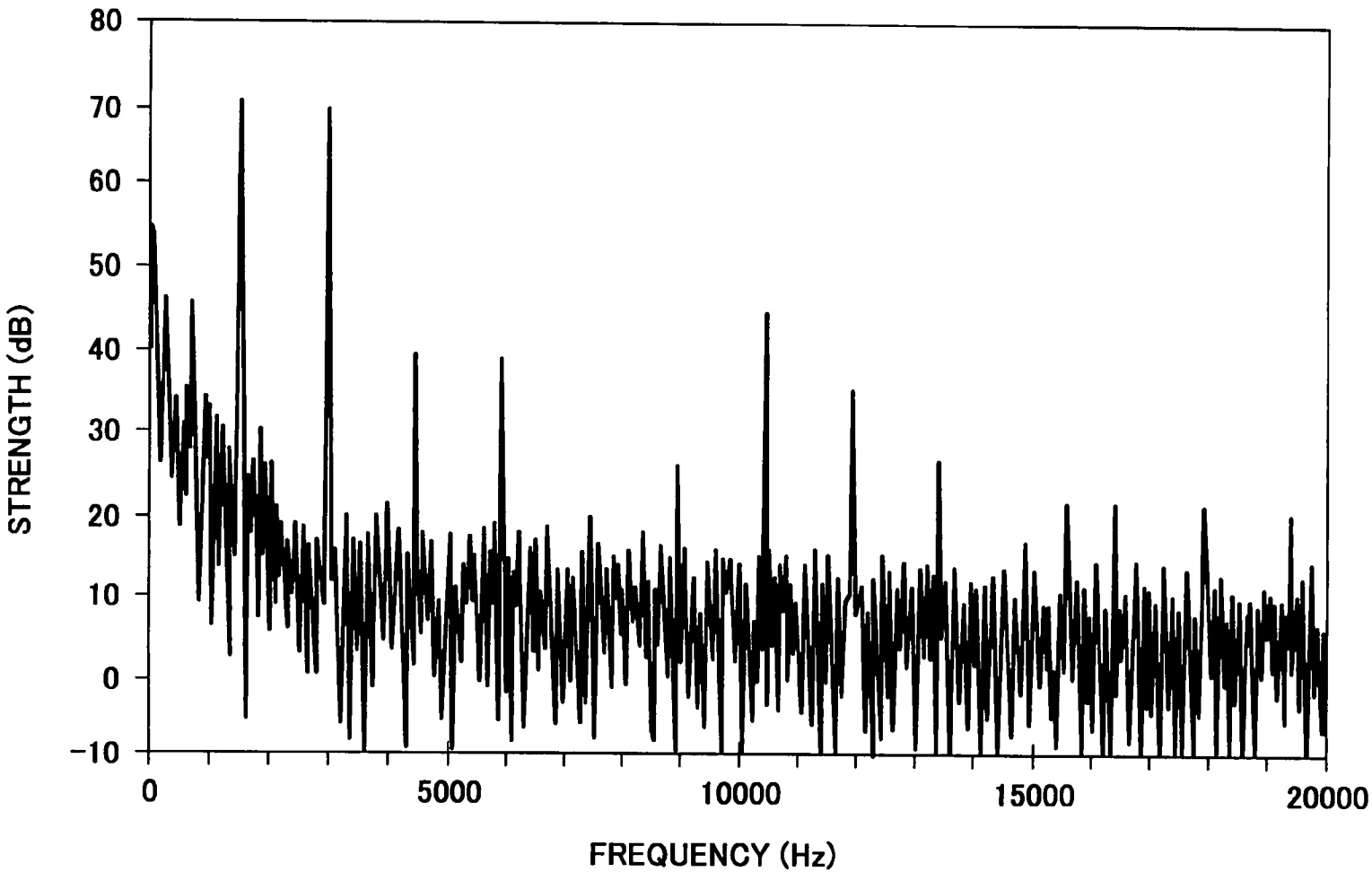
FIG. 10 is a graph showing the result of Fourier transform effected with the waveform pattern of sound output from a printer of Comparative Example 1 at the time of charging.

Comparative Example 1 has the same configuration as the first embodiment except for the following. The AC voltage source 23 generated an AC voltage having a frequency of 1,500 Hz and a peak-to-peak voltage of 2,000 V. The AC voltage was then superposed on a −700 V DC voltage output from the DC voltage source 22. The resulting sum voltage was applied to the charge roller 8. The result of image formation effected in this condition is also shown in FIG. 13. FIG. 10 shows a waveform produced by measuring sound output from the image forming apparatus at the time of charging and then subjecting it to Fourier transform.

As shown in FIG. 10, noticeable peaks appear at 1,500 Hz, 3,000 Hz, 4,500 Hz and 6,000 Hz. As a result, as shown in FIG. 13, sound with several frequency peaks is produced. It is to be noted that irregularity and other image defects were not observed in Comparative Example 1.

COMPARATIVE EXAMPLE 2

Comparative Example 2 uses the same configuration as the first embodiment except for the following. The AC voltage source 23 generated an AC voltage having a frequency of 400 Hz and a peak-to-peak voltage of 2,000 V. The AC voltage was then superposed on a −700 V DC voltage output from the DC voltage source 22. The resulting sum voltage was applied to the charge roller 8. The result of image formation effected in this condition is also shown in FIG. 13.

When sound output from the image forming apparatus was measured and then subjected to Fourier transform, noticeable peaks appear at 40 Hz, 800 Hz and 1,200 Hz, although not shown specifically. As a result, as shown in FIG. 13, sound with several frequency peaks is produced. Also, some irregularity was observed in images.

COMPARATIVE EXAMPLE 3

Comparative Example 3 uses the same configuration as the third embodiment except for the following. The semiconductor memory 30 stores a waveform pattern produced by sampling a pink noise waveform pattern, which lies in the frequency range of 100 Hz and 20,000 Hz, at the sampling frequency of 5 kHz and then separating the frequency range of from 600 Hz to 1,500 Hz with a band-pass filter.

The AC voltage source 23 generated an AC voltage by amplifying the waveform pattern stored in the memory 30 such that the peak-to-peak voltage is 1,800 V. The AC voltage was then superposed on a −700 V DC voltage output from the DC voltage source 22. The resulting sum voltage was applied to the charge roller 8. The result of image formation effected in this condition is also shown in FIG. 13.

When sound output from the image forming apparatus was measured and then subjected to Fourier transform, no noticeable peaks appeared over the entire frequency band. However, as FIG. 13 indicates, irregularity was observed in images.

In summary, it will be seen that the present invention provides an image forming apparatus having various unprecedented advantages, as enumerated below.

(1) A DC voltage and an AC voltage, which has the waveform pattern of particular noise and frequency lying in a particular range, are superposed and then applied to a charge roller. Therefore, abnormal sound having several frequency peaks are obviated at the time of charging without bringing about irregular charging.

(2) The waveform pattern of particular noise is generated by a DSP, so that high-speed image formation is promoted.

(3) By storing the waveform pattern of particular noise in a semiconductor memory, it is possible to faithfully reproduce the waveform pattern of the AC voltage to be superposed. The image forming apparatus is therefore highly reliable.

(4) By suitably selecting a waveform pattern having particular frequency in accordance with conditions of operation, it is possible to provide the AC voltage with an adequate waveform pattern. It is therefore possible to obviate abnormal sound having several frequency peaks at the time of charging and form desirable images without regard to the conditions of use.

Various modifications will become possible for those skilled in the art after receiving the teachings of the present disclosure without departing from the scope thereof.

What is claimed is:

1. A charging device comprising:

a charge roller adjoining or contacting a surface of a photoconductive element;

a DC voltage source configured to output a DC voltage; and an AC voltage source configured to output an AC voltage, the DC voltage and the AC voltage being applied to said charge roller, the AC voltage having a waveform pattern of at least one of white noise and pink noise.

2. The device as claimed in claim 1, wherein the AC voltage has a waveform pattern of white noise and a frequency of between 500 HZ and 4,000 Hz.

3. The device as claimed in claim 2, further comprising a DSP (Digital Signal Processor) configured to generate the waveform pattern of said at least one of the white noise and the pink noise.

4. The device as claimed in claim 1, wherein the AC voltage has a waveform pattern of the pink noise and a frequency of between 500 Hz and 4,000 Hz.

5. The device as claimed in claim 4, further comprising a DSP (Digital Signal Processor) configured to generate the waveform pattern of said at least one of the white noise and the pink noise.

6. A process cartridge comprising:

a photoconductive element;

a cartridge case by which said photoconductive element is rotatably supported;

a charging device disposed in said cartridge case and configured to establish a potential difference between said charging device and said photoconductive element to thereby uniformly charge a surface of said photoconductive element; and a developing device disposed in said cartridge case and configured to feed toner to the surface of said photoconductive element;

said charging device comprising:

a charge roller adjoining or contacting a surface of said photoconductive element;

a DC voltage source configured to output a DC voltage; and an AC voltage source configured to output an AC voltage, the DC voltage and the AC voltage being applied to said charge roller, the AC voltage having a waveform pattern of at least one of white noise and pink noise.

7. An image forming apparatus comprising:

a process cartridge comprising a photoconductive element, a cartridge case by which said photoconductive element is rotatably supported, a charging device disposed in said cartridge case and configured to establish a potential difference between said charging device and said photoconductive element to thereby uniformly charge a surface of said photoconductive element, and a developing device disposed in said cartridge case and configured to feed toner to said surface of said photoconductive element;

an optical scanning unit configured to optically scan the surface of said photoconductive element charged by said charging device; and an image transferring device configured to transfer the toner from the surface of said photoconductive element to a recording medium;

said charging device comprising:

a charge roller adjoining or contacting a surface of said photoconductive element;

a DC voltage source configured to output a DC voltage; and an AC voltage source configured to output an AC voltage, the DC voltage and the AC voltage being applied to said charge roller, the AC voltage having a waveform pattern of at least one of white noise and pink noise.

8. An image forming apparatus comprising:

a photoconductive element;

a charging device configured to establish a potential difference between said charging device and said photoconductive element to thereby uniformly charge a surface of said photoconductive element, said charging device comprising a charge roller adjoining or contacting a surface of said photoconductive element, a DC voltage source configured to output a DC voltage, an AC voltage source configured to output an AC voltage, the DC voltage and the AC voltage being applied to said charge roller, the AC voltage having a waveform pattern of at least one of white noise and pink noise;

an optical scanning device configured to optically scan the surface of said photoconductive element charged by said charging device;

a developing device configured to transfer toner to the surface of said photoconductive element scanned by said optical scanning device; and an image transferring device configured to transfer the toner from the surface of said photoconductive element to a recording medium.

9. A copier comprising:

an image reading device configures to read a document image; and an image forming apparatus configured to form an image on a recording medium in accordance with image data output from said image reading device;

said image forming apparatus comprising:

a process cartridge comprising a photoconductive element, a cartridge case by which said photoconductive element is rotatably supported, a charging device disposed in said cartridge case and configured to establish a potential difference between said charging device and said photoconductive element to thereby uniformly charge a surface of said photoconductive element, and a developing device disposed in said cartridge case and configured to feed toner to said surface of said photoconductive element;

an optical scanning unit configured to optically scan the surface of said photoconductive element charged by said charging device; and an image transferring device configured to transfer the toner from the surface of said photoconductive element to a recording medium;

said charging device comprising:

a charge roller adjoining or contacting a surface of the photoconductive element;

a DC voltage source configured to output a DC voltage; and an AC voltage source configured to output an AC voltage, the DC voltage and the AC voltage being applied to said charge roller, the AC voltage having a waveform pattern of at least one of white noise and pink noise.

10. A copier comprising:

an image reading device configured to read a document image;

an image forming apparatus configured to form an image on a recording medium in accordance with image data output from said image reading device;

a photoconductive element;

a charging device configured to establish a potential difference between said charging device and said photoconductive element to thereby uniformly charge a surface of said photoconductive element, said charging device comprising a charge roller adjoining or contacting a surface of a photoconductive element, a DC voltage source configured to output a DC voltage and an AC voltage source configured to output an AC voltage, the DC voltage and the AC voltage being applied to said charge roller, the AC voltage having a waveform pattern of at least one of white noise and pink noise;

an optical scanning device configured to optically scan the surface of said photoconductive element charged by said charging device;

a developing device configured to transfer toner to the surface of said photoconductive element scanned by said optical scanning device; and an image transferring device configured to transfer the toner from the surface of said photoconductive element to a recording medium.

* * * * *